US008596834B2

(12) United States Patent
Franck et al.

(10) Patent No.: US 8,596,834 B2
(45) Date of Patent: Dec. 3, 2013

(54) HEATSINK AND ILLUMINATION SYSTEM WITH A HEATSINK

(75) Inventors: Felix Franck, Munich (DE); Alessandro Maschietto, Paese (IT); Alessandro Scordino, Mestre (IT)

(73) Assignee: OSRAM Gesellschaft mit Beschränkter Haftung, Munich (DE)

( * ) Notice: Subject to any disclaimer, the term of this patent is extended or adjusted under 35 U.S.C. 154(b) by 658 days.

(21) Appl. No.: 11/906,415

(22) Filed: Oct. 1, 2007

(65) Prior Publication Data

US 2008/0089077 A1 Apr. 17, 2008

(30) Foreign Application Priority Data

Sep. 29, 2006 (EP) ..... 06020603

(51) Int. Cl.
*F21V 15/00* (2006.01)

(52) U.S. Cl.
USPC ..... 362/365; 362/364; 362/294; 362/373

(58) Field of Classification Search
USPC ..... 362/294, 373, 147, 364–365; 361/704–709
See application file for complete search history.

(56) References Cited

U.S. PATENT DOCUMENTS 6,132,069 A 10/2000 Sato et al.
6,385,047 B1 * 5/2002 McCullough et al. ..... 361/704
2003/0081419 A1 * 5/2003 Jacob et al. ..... 362/364
2003/0214803 A1 * 11/2003 Ono et al. ..... 362/1
2006/0221620 A1 * 10/2006 Thomas ..... 362/364

FOREIGN PATENT DOCUMENTS

| | | | |
|---|---|---|---|
| CN | 1680749 | A | 10/2005 |
| CN | 1681112 | A | 10/2005 |
| DE | 38 41 861 | | 7/1989 |
| DE | 201 17 506 | | 2/2002 |
| EP | 0 545 045 | | 6/1993 |
| EP | 1 233 233 | | 8/2002 |
| FR | 1 358 549 | | 4/1964 |
| FR | 2 653 858 | | 5/1991 |
| JP | 10-040734 | A | 2/1998 |
| JP | 10-214516 | | 8/1998 |
| WO | WO 2005/088190 | | 9/2005 |
| WO | WO 2005/098971 | A1 | 10/2005 |

* cited by examiner

*Primary Examiner* — Sean Gramling
(74) *Attorney, Agent, or Firm* — Cozen O'Connor

(57) ABSTRACT

A heatsink (2), comprising a heatsink body (3) extending between two endsides (4, 5) of the heatsink body. The heatsink is designed for introducing the heatsink with the first endside ahead into an aperture (16), which is provided in a wall (17), and for a thermal conductive connection of a heat-generating element (14) to the second endside, with a main direction of extent (6) of the heatsink body (3) from the first endside (4) to the second endside (5) being bent or sharply bent. Furthermore, an illumination system with such a heatsink is disclosed.

28 Claims, 3 Drawing Sheets

HEATSINK AND ILLUMINATION SYSTEM WITH A HEATSINK

RELATED APPLICATION

This patent application claims the priority of European patent application 06020603.4 filed Sep. 29, 2006, the disclosure content of which is hereby incorporated by reference.

FIELD OF THE INVENTION

The invention relates to a heatsink and an illumination system comprising a heatsink.

BACKGROUND OF THE INVENTION

Common heatsinks, in particular for illumination systems, intended for use in regions that are hard to access often suffer from comparatively poor heat dissipation properties.

SUMMARY OF THE INVENTION

It is an object of the invention to provide for a heatsink that allows for large-area heat dissipation in regions that are comparatively inaccessible from outside the region. Additionally, an illumination system with such a heatsink should be provided for.

This and other objects are attained in accordance with one aspect of the present invention directed to a heatsink comprising a heatsink body extending between two endsides of the heatsink body, wherein the heatsink is designed for introducing the heatsink with the first endside ahead into an aperture, which is provided in a wall, and for a thermal conductive connection of a heat-generating element to the second endside, with a main direction of extent of the heatsink body from the first endside to the second endside being bent or sharply bent.

The heatsink can also be designed for fixing the heatsink at the wall, preferably in the aperture, in particular from within the aperture, on the part of the second endside.

The two endsides of the heatsink body can be laterally and preferably vertically spaced apart from one another as seen from either one of the endsides.

A heatsink with a heatsink body which has a curved, i.e. bent, main direction of extent or a main direction of extent that has a kink, i.e. a sharply bent main direction, allows for introducing the heatsink body into the aperture such that a part of the heatsink body, which was guided through the aperture, extends laterally beyond the edge of the aperture. In particular, the first endside of the introduced heatsink may be arranged laterally beside and preferably at a vertical distance from the aperture. In comparison with a heatsink having a straight main direction of extent, such as a cylindrical heatsink for example, the area of the heatsink which can be guided through the aperture may be increased and the vertical extension of the introduced heatsink can be decreased in this way.

The invention is particularly advantageous for a heat sink, that is to be inserted in a comparatively inaccessible region, such as a hollow space, for example, with the aperture providing an access, preferably the only access, to this area. Said aperture may, for example, be formed by means of a recess in a false ceiling, in a double ceiling or in a floor. For example, an element delimiting the available space for the heatsink, such as a further wall or a main wall, can be arranged at a vertical distance from the aperture. An aperture which extends itself through the entire wall, i.e. from a first side of the wall to a second side of this wall, is particular preferred.

If a straightly extending and thus unbent heatsink was introduced in such an aperture, the surface-area of the heatsink which can be guided through the aperture would be delimited by the distance between the delimiting element and the heatsink. By bending or sharply bending the main direction of extent of the heatsink body, the surface-area of the heatsink being arranged in the aperture may be enlarged. In particular, the length of that part of the heatsink body which can be guided through the aperture can be greater than the distance of the delimiting element extending over the aperture from that side of the aperture which is remote from the delimiting element. An enlarged area of the heatsink body guided through the aperture improves heat dissipation from the heat-generating element in the region the aperture provides access to and thus reduces the danger of failure of the heat-generating element due to excess heat which is not properly dissipated from the element.

Good heat dissipation is particularly advantageous if the heat-generating element does not serve the sole purpose of heat-generation but the heat generated during the operation of the element is loss heat. An element generating loss heat during operation can be an electromagnetic-radiation generating element, in particular a visible light-generating element, such as a halogen bulb or a light-emitting diode (LED), for example. Even though LEDs are very efficient and reliable radiation sources, a High-power light-emitting diode, for example a light-emitting diode having a power consumption of 1 W or more or 2 W or more, generates loss heat to a comparatively great extent. In order to avoid thermally caused failure of the radiation generating component, the heat should be properly dissipated from the component during operation.

In a preferred embodiment, the aperture provides an access to a free space, in particular a hollow space, into which the heatsink is to be introduced. The free space can be bounded by means of two walls, the aperture being provided in the first wall and the second wall being arranged at a distance from the first wall and extending over the aperture. The length of that part of the heatsink, which is to be guided through the aperture, can, on account of the shape of the heatsink body, be greater than the distance of the second wall from that side of the aperture which is remote from the second wall.

In a further preferred embodiment, the heat-generating element is fixed to the second endside of the heatsink body. The heat-generating element and/or the second endside of the heatsink body can protrude from that side of the aperture which is remote from the first endside of the introduced heatsink.

In a further preferred embodiment the heatsink body and/or the main direction of extent is U-like, V-like or L-like shaped, preferably with one leg of the U or the V being shorter than the other leg, respectively. It is preferred for the first endside to be arranged at the shorter leg of the U or the V, respectively. The first endside can thus be arranged at distance from the wall the aperture is provided in, after the heatsink was introduced and preferably fixed to the wall. Preferably the U-like shape resembles the shape of a bent open U, like the basic shape of a banana, for example.

The second endside of the heatsink is preferably arranged at the longer leg of the U or the V, respectively.

In a further preferred embodiment, the heatsink has a fixing means for fixing, in particular detachably fixing, the heatsink at the wall, preferably in the aperture, particular preferably from within the aperture. A detachable fixing of the heatsink into the aperture allows for detaching the heatsink without damaging the heatsink structure. In case of failure of the heat-generating element, the heat-generating element can be replaced and the heatsink can be reused and reinserted into the aperture. A reusable heatsink is particular suitable for a spotlight.

Furthermore, it is preferred for the fixing means to be arranged and/or provided in the region of the second endside of the heatsink body.

The fixing means preferably comprises a lever element and a spring element. The lever element may, as well as the spring element, be connected to the heatsink body. The spring element may be connected to the lever element and to the heatsink body. The spring element is expediently capable of pressing the lever element to the wall, in which the aperture is provided, for fixing the heatsink in the aperture on the part of the second endside.

The fixing means, in particular the lever element, is preferably designed to extend through the aperture and to be accessible from that side of the aperture which is remote from the first endside of the introduced heatsink body. By designing the fixing means, in particular the lever element, like this, actuation of the fixing means from outside of an inaccessible region into which the heatsink was introduced is facilitated. If the fixing means can be accessed from the outside, detaching the heatsink from the wall is facilitated.

In a further preferred embodiment, the lever element comprises one protruding element or a plurality of protruding elements. The protruding element(s) can be designed as a snap-fit element(s). The lever element can engage the wall with the aperture in particular from inside the aperture, such that the heatsink is mechanically fixed in the aperture on the part of the second endside. It is preferred for the lever element, in particular for a protruding element, to engage an edge of the aperture in the wall which is remote from the second endside of the heatsink body or remote from the heat-generating element.

If a plurality of protruding elements are provided, these elements are preferably adapted for fixing the heatsink in apertures being provided in walls of different thicknesses. Fabrication of separate lever elements adapted to walls of different thicknesses and in consequence to apertures of different depths can thus be dispensed with.

It is furthermore preferred for the heatsink body to have a mounting recess, into which the fixing means can be at least partly sunk. The lateral extension of the heatsink in a lateral direction as seen from the main direction of extent can be reduced by sinking the fixing means into the heatsink body. The heatsink body can therefore be formed with a higher cross-sectional area such as compared to a heatsink having a fixing means unsinkable in the heatsink body and simultaneously be guidable through an aperture of a given shape.

In a further preferred embodiment the heatsink comprises a supporting means. The supporting means is preferably arranged and/or provided in the region of the first endside of the heatsink body. The supporting means is expediently capable of mechanically supporting that part of the heatsink body which was guided through the aperture. In particular, the supporting means can be designed to avoid a shift in the fixing means due to a torque acting on the second endside on account of an unsupported weight of the heatsink body on the part of the first endside. The supporting means is preferably designed to mechanically contact the wall with the aperture at a distance from the aperture. The supporting means is preferably connected to the heatsink body.

The supporting means preferably comprises a supporting lever and a supporting spring. The supporting spring is preferably capable of balancing the weight of the heatsink body, for example by pressing the heatsink body away from the wall with the aperture. The supporting lever may, as well as the supporting spring, be connected to the heatsink body. The supporting spring may be connected to the supporting lever and to the heatsink body.

Furthermore, it is preferred for the supporting means, in particular for the lever element, to have a rounded end portion on that side of the supporting means which is remote from the heatsink body. Introduction of the heatsink into the aperture may be facilitated by means of the rounded end portion, since in case of a slightly detached arrangement of the heatsink body with respect to the aperture a rounded end portion may contact an edge of the aperture mechanically and guide the heatsink body into the aperture.

It is furthermore preferred for the heatsink body to have a recess, into which the supporting means can be at least partly sunk. The lateral extension of the heatsink in a lateral direction as seen from the main direction of extent can be reduced by sinking the supporting means into the heatsink body. The heatsink body can therefore be formed with a higher cross-sectional area such as compared to a heatsink having a supporting means unsinkable in the heatsink body and simultaneously be guidable through an aperture of a given shape.

In a further preferred embodiment the heatsink body has a cross-sectional shape that matches the shape of the aperture in plan view onto the aperture. The cross section is preferably taken perpendicularly to the main direction of extent. The heatsink body and the aperture may, for example, have a circular cross-section. Cross-sections of the same shape allow for a heatsink body which is introducible into the aperture to be formed with a particularly high cross-sectional area.

The cross-sectional area of a cross-section taken perpendicularly with respect to the main direction of extent of that part of the heatsink body which is to be guided through the aperture is preferably 70% or more of the surface area of the aperture as seen in plan view onto the aperture.

An illumination system in accordance with an embodiment of the invention comprises a heatsink in accordance with an embodiment of the invention as it is described above, said heatsink being fixed in the aperture and a light-emitting component being fixed to the heatsink. The light-emitting component can be embodied as a spotlight. Furthermore, the light-emitting component can be thermally conductively connected to the heatsink body.

DETAILED DESCRIPTION OF THE DRAWINGS

Identical elements, identically acting elements and elements of the same kind are provided with the same reference numbers in the figures.

Figure 1:
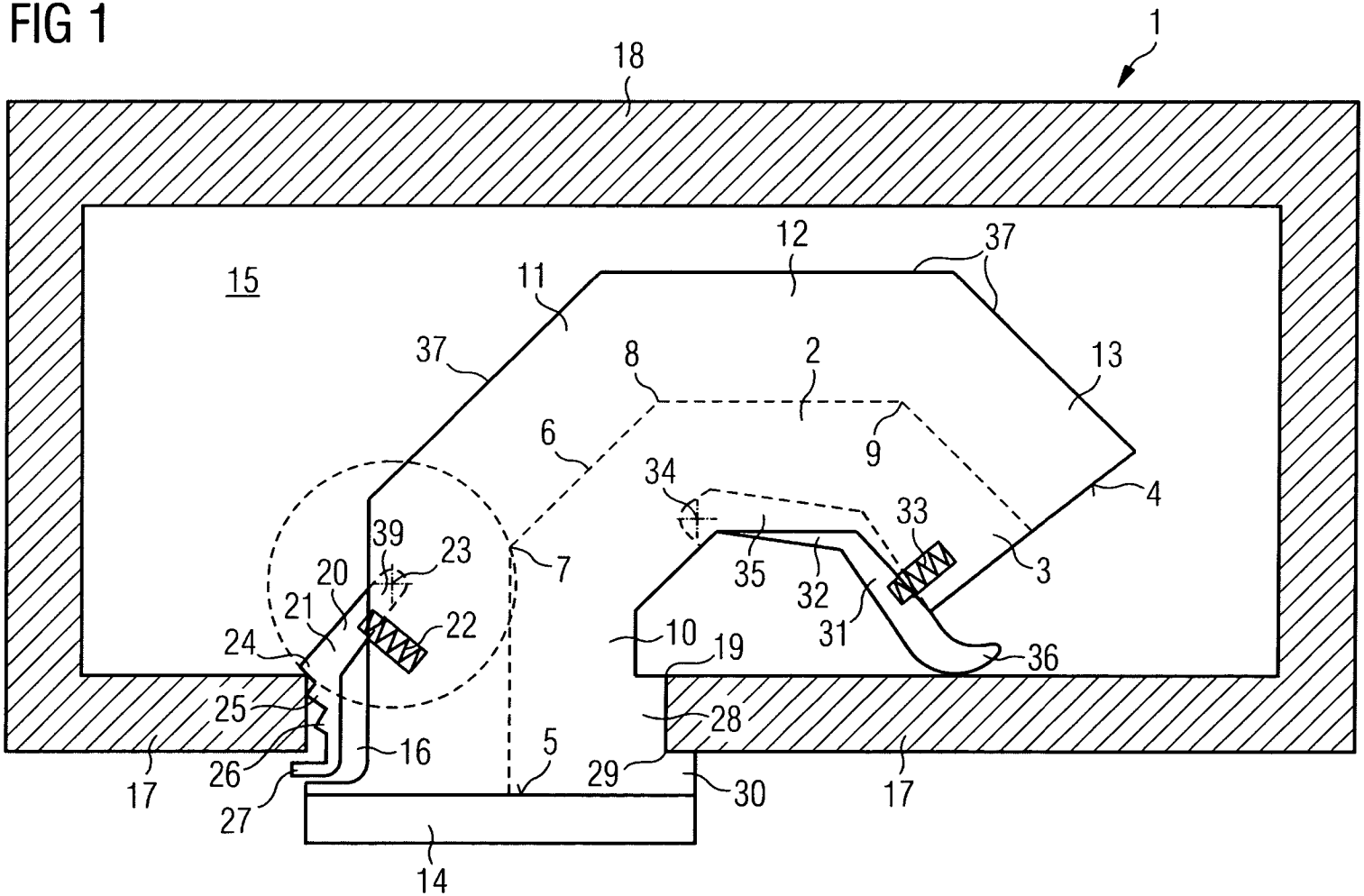
FIG. 1 shows a schematic sectional view of an illumination system with a heatsink in accordance with an embodiment of the invention.

FIG. 1 shows a schematic sectional view of an illumination system 1 that comprises a heatsink 2 in accordance with an embodiment of the invention.

The heatsink 2 comprises a heatsink body 3. The heatsink body 3 extends between a first endside 4 and a second endside 5 in a main direction 6 of extent of the heatsink body. The heatsink is preferably embodied in elongated fashion.

The heatsink body may contain a metal or an alloy, like copper, aluminum, zinc, a copper alloy, an aluminum alloy or a zinc alloy, for example. A heatsink in each case serves for the dissipation of heat and, thus, expediently has an appropriate high thermal conductivity. Metals or alloys are particularly suitable for this purpose.

The thermal management of the heatsink may be improved by applying an additional treatment to the heatsink, in particular to the heatsink body. Heat dissipation can thus be improved. For this purpose, a surface of a heatsink body may be coated, for example by painting, in particular using a dark material, preferably a black material, or roughened, for example by a powder treatment. A roughened surface has an enlarged surface area and the heat dissipation is improved in consequence. The heatsink, in particular the heatsink body, may—additionally or alternatively—also be chromed or treated by anodization. The thermal management of the heatsink and/or the optical impression of the heatsink may be improved by these measures.

The main direction of extent 6 is sharply bent and preferably shows a plurality of bending points, e.g. bending points 7, 8 and 9, corresponding to the transition points between differently bent regions of the main direction 6.

The bending points are arranged in transition regions between a plurality of partial regions, e.g. regions 10, 11, 12 and 13, which the heatsink body 3 has. The main direction of extent runs straight in the respective partial region. The partial region 10 includes the second endside 5. The partial region 13 includes the first endside 4. Partial regions 11 and 12 are arranged between the regions 10 and 13. The cross-sections of the partial regions 11, 12 and 13 can resemble a trapezoidal form. Forming partial regions of this kind next to one another results in sharply bending of the main direction of extent 6. A side face 37 of the heatsink body can extend evenly along the main direction 6. The side face 37 can be curved azimuthally with respect to the main direction 6.

However, alternatively the heatsink body 3 could, in cross-sectional view taken in a cross-section along the main direction of extent 6, as it is shown in FIG. 1, also have a curved side face. This would result in the main direction of extent being curved, i.e. bent, and not sharply bent (not explicitly illustrated). A shape of this kind can be achieved by bending a cylinder into a U-like shape, for example.

A cross-section of the heatsink body 3 taken perpendicularly with respect to the main direction of extent 6 is preferably of a circular shape. The partial regions 11, 12 and 13 can be formed according to body parts cut out from a cylinder. The heatsink body 3 is preferably formed as a single-pieced body.

The shape of the main direction of extent 6 and preferably the shape of the heatsink body resembles an U with the leg of the U on the part of the first endside 4 being shortened with respect to the U-leg on the part of the second endside 5.

Alternatively the main direction can also be embodied in a V-like shape with a shortened V-leg or in L-like shape (not illustrated). The respective shorter side is intended for introducing the heatsink body into the aperture.

An electromagnetic radiation, in particular visible light, generating element 14 is thermally conductively connected to and fixed to the second endside 5 of the heatsink body 3. The radiation-generating element is preferably embodied as a light-emitting diode, an array with a plurality of light-emitting diodes or a halogen-based light source, like a halogen bulb, for example. The radiation-generating element may have a shape that is matched to the shape of the aperture as seen in plan view onto the element. Heat generated during operation of the radiation-emitting element can be dissipated from the element by means of the heatsink 2.

The heatsink 2 extends through an aperture 16 of a wall 17 into a free space 15, in particular a hollow space which is bounded on all sides. The heatsink 2 is introduced into the free space 15 with the first endside 4 ahead. The free space, in particular the hollow space, may, for example, be formed in a ceiling, in particular a double ceiling, a sidewall or a floor.

Preferably, the cross-sectional shape of the heatsink body of a cross section taken perpendicularly with respect to the main direction of extent 6, is matched to the shape of the aperture. The aperture may have a circular shape as seen in plan view onto the aperture from that side of the aperture being remote from the free space 15. Thus, the cross section of the heatsink body 3 may have a circular shape as well.

The free space 15 is bounded by the further wall 18 which is arranged vertically at a distance from wall 17 and extends over the complete aperture 16.

On account of the bent shape, that part of the heatsink body 3 which is introduced into the free space 15 through the aperture 16 has a length, preferably taken along the main direction of extent, that exceeds the distance between the further wall 18 and that side of wall 17 which is remote from the further wall 18. This allows for the surface area of the heatsink body which is arranged inside the free space 15 to be increased as compared to a straight extending heatsink 2. Heat dissipation is thus improved. Preferably, the aperture provides the only access to that part of the free space 15 into which a bent heatsink of a given shape can be arranged in through this aperture.

The heatsink extends laterally beyond the edge 19 of the aperture with the heatsink body. In particular, partial regions 11, 12 and 13 are arranged vertically and laterally at a distance from the aperture 16 and from wall 17.

The heatsink 2 has a fixing means 20. The fixing means is preferably designed for detachably fixing the heatsink to the wall 17 and in particular, from within the aperture 16. The fixing means 20 is arranged in the region of the second endside 5 of the heatsink body 3, in particular in the partial region 10 of the heatsink body, and expediently within the aperture.

The fixing means comprises a lever element 21 and a spring 22. The lever element 21 is connected to the heatsink body 3 and in particular, pivoted at that side of the lever element which faces the heatsink body 3. The lever element 21 can be pivoted around an axis 23. The axis 23 preferably runs essentially perpendicular with respect to the main direction of extent 6. The pivoted embodiment of lever element 21 is indicated by the dashed circle line in FIG. 1.

The spring 22 is connected with the heatsink body and with the lever element 21. The spring 22 is preferably designed such that the lever element 21 is pressed away from the heatsink body 3 such that the lever element is pressed against wall 17 and engages the wall. For this purpose, an appropriate force can be applied to the lever element 21 by means of the spring for fixing the heatsink 2 in the aperture 16.

The lever element 21 further has a plurality of protruding elements 24, 25 and 26 which can be formed by elevations of the surface of the lever element which faces the wall 17. The protruding elements are preferably designed for mechanical contact to wall 17. The protruding elements can be embodied by means of a teeth-like or groove-like structure in the lever element 21. An engaging connection, like a snap-fit connection, can be established in this way for mechanically fixing the heatsink in the aperture.

Element 24 mechanically contacts the edge 19 of the aperture. Element 25, which is arranged on that side of protruding element 24, which is further away from the heatsink body 3 as seen along the surface of lever element 21, is mechanically contacting the wall on the inner side of aperture 16. Elements 24 and 25 encompass the edge 19 of the aperture. Elements 24 and 25 thus contribute to a mechanically stable fixing of the heatsink 2 to the wall 17.

By means of providing a plurality of, in particular, three or more protruding elements, the lever element 21 can be adapted for mechanically stable fixing of the heatsink to walls of different thicknesses and thus in apertures having different depths. For this purpose, protruding element 26 is provided in FIG. 1.

It is preferred for that side of a protruding element, which is further away from the heatsink body 3, as seen along the surface of lever element 21 to be embodied in curved fashion. Particular preferably, this remote side of the protruding element is curved with a radius of curvature determined by a circle around axis 23 (cf. the dashed circle). Detaching the heatsink from the wall by pressing the lever element 21 in the direction of the heatsink body may thus be facilitated with the danger of damage to a protruding element of the lever element 21 being reduced.

Lever element 21 extends from inside the free space 15 through the aperture 16 to the side of the aperture opposite from the free space. On the side remote from the heatsink body, the lever element has an actuation element 27, this actuation element allowing actuation of the lever element from the outside. Detachment of the heatsink from the wall 17 from the outside can be achieved in this way. For doing so, actuation element 27 may be pressed into the direction of the heatsink body 3 such that a free space between the heatsink body 3 and the lever element 21 is narrowed. The heatsink 2 can be removed from the free space 15 afterwards with the radiation-generating element 14 ahead.

While the fixing means 20 is pressed against the wall 17 for fixture of the heatsink 2, the heatsink body 3 is preferably also pressed against the wall 17 on the side remote from the fixing means 20 by means of the spring force of spring 22. It is preferred for a protrusion 28 of the heatsink body 3 to be in mechanical contact with the inner side of the aperture in this case. On the side remote from the first endside 4, the heatsink body 3 may extend itself laterally beyond an edge 29 of the aperture. In particular, the heatsink body 3 may be in mechanical contact with the wall 17 laterally at a distance from the aperture on that side of the wall which is remote from the first endside 4 of the heatsink body 3. A protrusion 30 may be provided in the heatsink body 3 for this purpose at the second endside 5.

A mounting recess 39 is provided in the heatsink, in particular in the heatsink body 3, into which mounting recess the lever element 21 can be at least partly sunk. The portion of the lever element 21 sunk into the heatsink 3 is indicated by the dashed lines which lever element 21 shows. Introducing the heatsink in and guiding the heatsink through the aperture 16 can be facilitated in this manner by pressing the lever element 21 manually into the mounting recess 39.

The heatsink 2 further comprises a supporting means 31. The supporting means comprises a supporting lever 32 and a supporting spring 33. The supporting lever 32 is connected to the heatsink body 3. Preferably the supporting lever 32 is pivoted at the side of the heatsink body 3. Thus, the supporting lever 32 can be turned around an axis 34 which runs preferably essentially perpendicular to the main direction 6. The spring 33 is preferably connected to the heatsink body 3. Furthermore, it is preferred for the supporting spring 33 to be connected to the supporting lever 32.

The supporting means 31 is arranged in the region of the first endside 4 of the heatsink body 3. By means of the supporting means 31, a torque acting on the second endside 5 of the heatsink body which is caused by the tail-like overhanging first endside 4 can be compensated for. The supporting lever 32 is preferably in mechanical contacted with a wall inside free space 15, preferably with the wall 17 at a distance from the aperture. The spring 32 presses the first endside 4 of the heatsink body 3 away from wall 17 and thus lifts and holds the "tail" of the heatsink body.

A recess 35 is provided in the heatsink, in particular in the heatsink body 3, into which recess the supporting lever 32 can be sunk. The portion of the supporting lever 32 sunk into the heatsink 3 is indicated by the dashed lines which supporting lever 32 shows. Introducing the heatsink in and guiding the heatsink through the aperture 16 can be facilitated in this manner by pressing the supporting lever 32 manually into the recess 35.

Furthermore, an endside of the supporting lever 32 has a rounded end portion 36. The rounded end portion can also contribute to an easy introduction of the heatsink 2 into and to guidance of the heatsink 2 through the aperture.

The radiation-emitting element 14 is particularly preferably formed as a spotlight. Due to the easy mountability/dismountability of the heatsink to/from a wall from within an aperture, the heatsink can be easily detachedly from the wall. Replacement of spotlights is thus facilitated without increasing the danger of damaging the heatsink, in particular its fixture or supporting means during detachment and extrusion of the heatsink from the free space.

Additionally, a heatsink in accordance with the invention provides for a heatsink having a large surface area, which is introducible into a free space having a comparatively small room between a wall in which the aperture is provided and a wall extending above the aperture.

FIGS. 2A to 2D show the introduction of the heatsink described above on the basis of schematic perspective views.

Figure 2A:
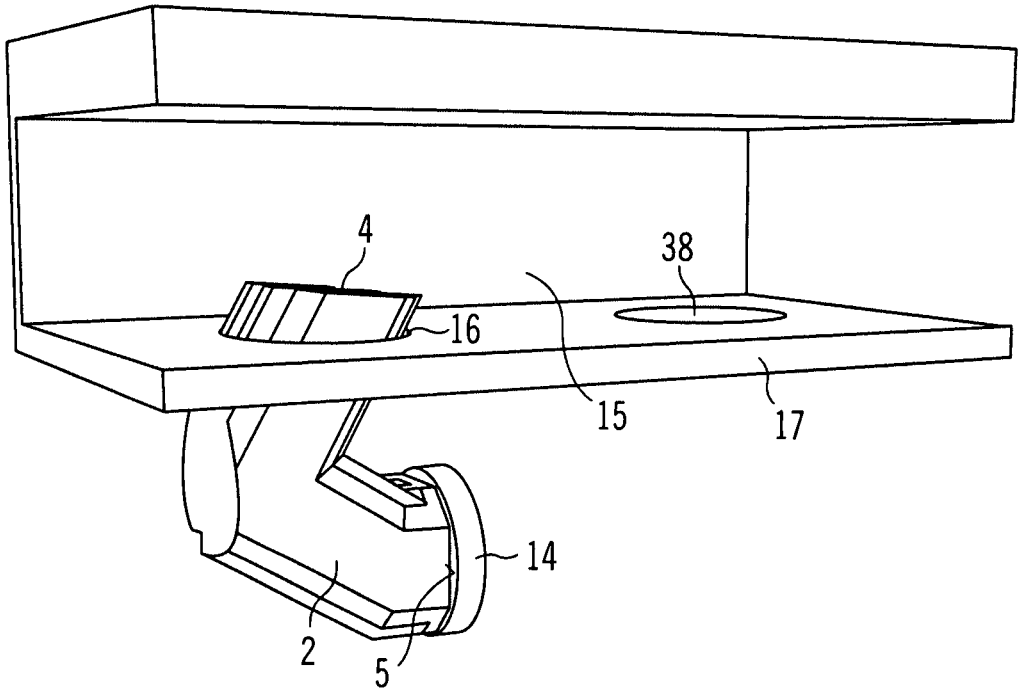
FIGS. 2A to 2D show schematic views of steps of the process of introducing a heatsink in accordance with an embodiment of the invention into an aperture.

Firstly the heatsink 2 is introduced into the aperture 16 with the first endside 4 ahead, FIG. 2A. Supporting means 31 is expediently pressed into the recess 35 during introduction (not explicitly illustrated). An additional aperture 38, in which a further heatsink can be introduced is illustrated in FIG. 2A. The part of the heatsink guided through the aperture preferably fills 70% or more, particular preferably 80% or more, of the surface area of the aperture as seen in plan view on the aperture during guidance of the heatsink body through the aperture.

Figure 2B:
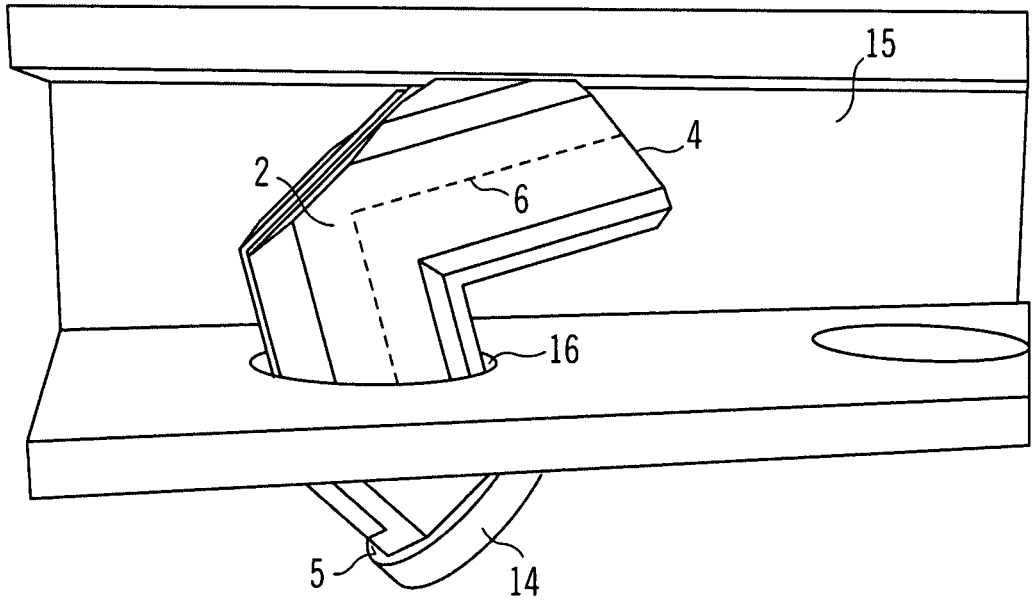
Figure 2C:
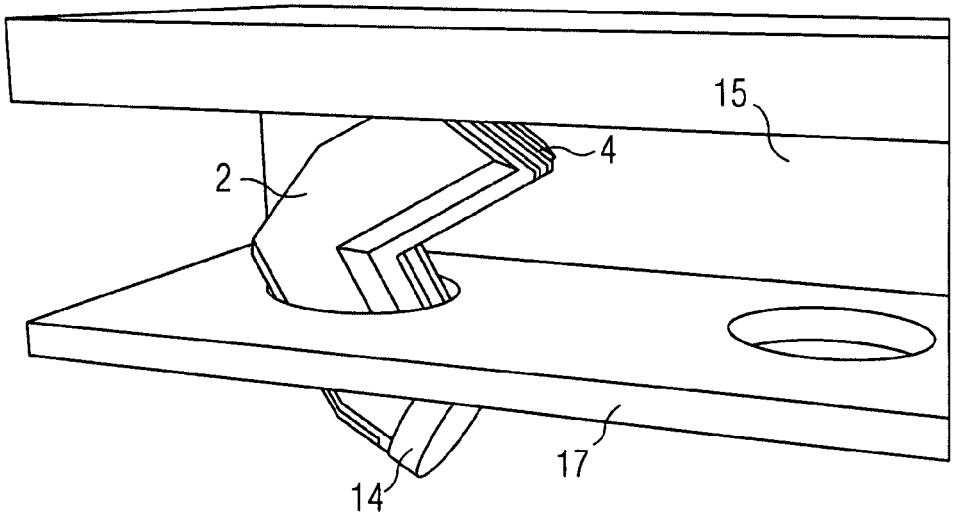
Figure 2D:
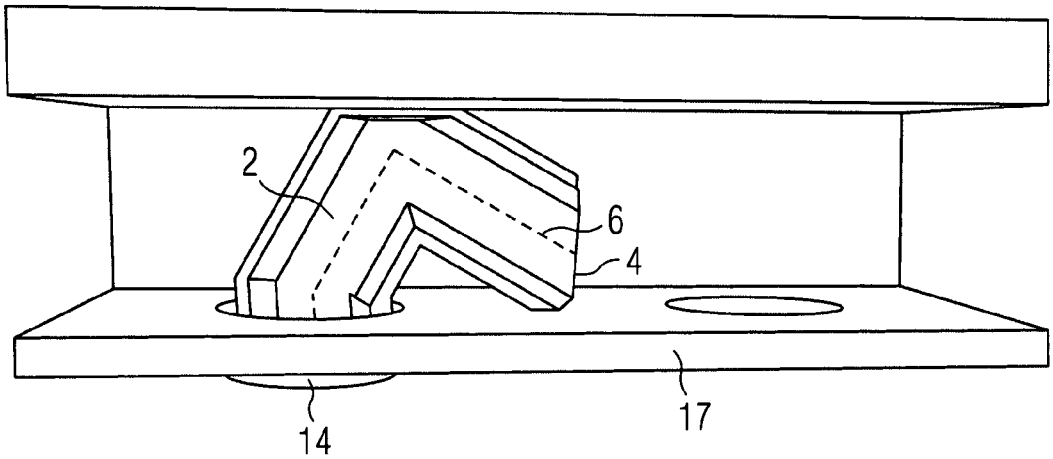

Afterwards, the heatsink is turned around an axis which runs essentially perpendicular to the main direction of extent 6, before mechanical contact is made to the further wall 18. After this step, the endside 4 is arranged at a vertical distance and at a lateral distance from the aperture 16 and the heatsink 2 is guided further through the aperture, FIGS. 2B and 2C. FIGS. 2B and 2C show different views of the same introduction step.

The radiation-generating element 14 is preferably, as well as the cross-sectional shape of the heatsink and the shape of the aperture, provided in a circular shape.

The side face 37 of the heatsink body can be curved azimuthally with respect to the main direction 6, preferably in accordance with a curvature of the aperture. Afterwards the heatsink 2 is again turned around an axis running essentially perpendicular to the main direction of extent 6 and is fixed by means of the fixing means 20 in the aperture 16 and mechanically stabilized by supporting means 31 (fixing means 20 and supporting means 31 not explicitly illustrated), FIG. 2D. Extrusion of the heatsink can be effected by reversing the introduction steps.

The invention is not limited to the exemplary embodiments given hereinabove. The invention is embodied in each novel characteristic and each combination of characteristics, which particularly includes every combination of any features which are stated in the claims, even if this feature or this combination of features is not explicitly stated in the claims or in the exemplary embodiments.

We claim:

1. A heatsink comprising a heatsink body extending between a first endside and a second endside of the heatsink body, wherein the first endside is adapted to be introduced ahead of the second endside into an aperture, which is provided in a wall;

wherein the second endside extends in a lateral direction and is configured for fixing and thermally conductively connecting to a heat-generating element;

wherein a main direction of extent of the heatsink body from the first endside to the second endside is bent;

wherein the extent of the heatsink body along the main direction is larger than an extent of the heatsink body in a vertical direction perpendicular to the lateral direction;

wherein the heatsink comprises a supporting means arranged in a region of the first endside, the supporting means comprises a supporting lever configured to pivot relative to the heatsink body about an axis that passes through the heatsink body;

wherein the heatsink body has a recess configured to receive thereinto at least part of the supporting means; and wherein a cross section of the heatsink body taken perpendicularly to the main direction of extent has a circular shape.

2. The heatsink according to claim 1, wherein the heatsink body is at least one of U-like shaped, V-like shaped and L-like shaped.

3. The heatsink according to claim 2, wherein one leg of the U or V-like shaped heatsink body is shorter than the other leg of the respective U or V-like shaped heatsink body.

4. The heatsink according to claim 3, wherein the first endside is arranged at the shorter leg of the U or V-like shaped heatsink body.

5. The heatsink according to claim 1, wherein the heat-generating element is an electromagnetic-radiation generating element.

6. The heatsink according to claim 5, wherein the electromagnetic-radiation generating element is a light-emitting diode.

7. The heatsink according to claim 1, wherein the heatsink body is adapted such that a part of the heatsink body, which is to be guided through the aperture, is extending laterally beyond an edge of the aperture when the heatsink body is fully inserted into the aperture.

8. The heatsink according to claim 1, wherein the aperture provides an access to a free space, into which the heatsink is to be introduced, said free space being bounded by means of two walls, the aperture being provided in the first wall and the second wall being arranged at a distance from the first wall and extending over the aperture.

9. The heatsink according to claim 8, wherein a length of a part of the heatsink, which is to be guided through the aperture, is greater than a distance of the second wall from a side of the aperture which is remote from the second wall.

10. The heatsink according to claim 1, wherein the heatsink has a fixing means configured to fix the heatsink in the aperture.

11. The heatsink according to claim 10, wherein the fixing means is arranged in a region of the second endside of the heatsink body.

12. The heatsink according to claim 10, wherein the fixing means comprises a lever element and a spring element, the spring element being capable of pressing the lever element to the wall for fixing the heatsink in the aperture on part of the second endside.

13. The heatsink according to claim 12, wherein the lever element is designed to extend through the aperture and to be accessible from a side of the aperture which is remote from the first endside.

14. The heatsink according to claim 12, wherein the lever element comprises one protruding element or a plurality of protruding elements for engaging the wall, the protruding elements being adapted to fix the heatsink in apertures provided in walls of different thicknesses.

15. The heatsink according to claim 10, wherein the heatsink body has a mounting recess, into which the fixing means can be at least partly sunk.

16. The heatsink according to claim 1, wherein the supporting means is configured to mechanically support a part of the heatsink body, which is to be guided through the aperture.

17. The heatsink according to claim 16, wherein the supporting means mechanically contacts the wall with the aperture at a distance from the aperture.

18. The heatsink according to claim 16, wherein the supporting means further comprises a supporting spring.

19. The heatsink according to claim 18, wherein the supporting spring is configured to press the heatsink body away from the wall with the aperture.

20. The heatsink according to claim 18, wherein the supporting lever has a rounded end portion on a side of the supporting lever which is remote from the heatsink body.

21. The heatsink according to claim 1, wherein the heatsink body has a cross-sectional shape that matches a shape of the aperture as seen in a plan view onto the aperture.

22. The heatsink according to claim 21, wherein the cross section of the aperture has a circular shape.

23. An illumination system comprising: a heatsink in accordance with claim 1, which is fixed in the aperture and a light-emitting component being fixed to the heatsink.

24. The illumination system according to claim 23, wherein the light-emitting component is a spotlight.

25. The heatsink according to claim 1, wherein the heatsink body at least partly extends beyond the second endside.

26. The heatsink according to claim 1, wherein the main direction of the heatsink body from the first endside to the second endside is sharply bent.

27. The heatsink according to claim 1, wherein the first endside is spaced apart from the second endside in the lateral direction and in the perpendicular direction.

28. The heatsink according to claim 10, wherein the fixing means is arranged in a region of the second endside of the heatsink body and configured to fix the heatsink body to the aperture at a position such that the first endside is on a first side of the wall and the second endside is on a second side of the wall, opposite the first side.

* * * * *